United States Patent [19]

Alsip

[11] Patent Number: 4,582,326

[45] Date of Patent: Apr. 15, 1986

[54] THREE DIMENSIONAL GAME

[76] Inventor: Bruce F. Alsip, 2310 Upper Farm Rd., Bainbridge Island, Wash. 98110

[21] Appl. No.: 697,836

[22] Filed: Feb. 4, 1985

[51] Int. Cl.[4] ..... A63F 3/00

[52] U.S. Cl. ..... 273/271; 273/273

[58] Field of Search ..... 273/241, 271, 273, 290

[56] References Cited

U.S. PATENT DOCUMENTS

| | | | |
|---|---|---|---|
| 680,324 | 8/1901 | Gedge | 273/273 X |
| 3,181,867 | 5/1965 | Dreyer | 273/273 X |
| 4,067,576 | 1/1978 | Balas | 273/273 X |
| 4,232,864 | 11/1980 | Yaworsky | 273/241 |
| 4,522,408 | 6/1985 | McKee | 273/271 |

*Primary Examiner*—Harland S. Skogquist

*Attorney, Agent, or Firm*—Jensen & Puntigam

[57] ABSTRACT

A game including a cubical main element 2 having a plurality of spaced vertical bores 4 extending therethrough. A removable receiving tray 10 is positioned beneath the bores during play such that the playing pieces 9 which are placed in the bores 4 can fall within receiving cups 12 within the tray 10. A selectively movable slide piece 16 is resiliently mounted beneath the receiving tray 10 and the main element 2 such that it effectively prevents game pieces from passing into the tray until deliberately actuated, such that a single layer of game pieces 9 may be dropped into the tray 10 each time the slide 16 is moved. The players slice off individual sequential layers of playing pieces enabling the scoring to be on a two-dimensional basis.

5 Claims, 4 Drawing Figures

THREE DIMENSIONAL GAME

TECHNICAL FIELD

This invention relates to a three dimensional game of skill which requires a player to perform or take his turn without being able to see the results of the previous plays. The scoring is based upon the relative placement of successive playing pieces.

BACKGROUND ART

Games, to have lasting value and ongoing use, must provide sufficient variety to maintain interest and sufficient challenge to spark competitiveness.

The present game, because of its configuration and means of scoring, accomplishes the two requirements in a unique stuctural fashion. The player, without being able to see the result of previous plays, must locate his piece in a three dimensional container in a position which will cause a score. The container confines successive pieces to a vertical stack but the choice of which one of the multiple columns available is used is dictated by chance or memory.

The pieces are removed from the container for scoring one layer at a time from the bottom and the score is generated by a plurality of identical playing pieces which form a straight line within the given layer.

The strategy then, is to remember the order in which the markers have been played to maximize the number of pieces lying in a straight line in a given plane while simultaneously preventing the opponent from accomplishing the same goal.

Prior art games known to the inventor which utilize multi-dimensional strategies include:

U.S. Pat. No. 680,324 granted to Gedge Aug. 13, 1901 which discloses a three-dimensional block with vertical bores into which flat distinguishable playing pieces are sequentially placed. The bottom of the block is hinged and has receiving cups such that the main portion of the block may be raised to determine the order in which the pieces have been played by the relative position in the stack.

U.S. Pat. No. 3,464,701 granted Sept. 2, 1969 to Mahoney discloses a three-dimensional tic-tac-toe game having a plurality of individual removable playing boards which are held in vertical alignment within a cube allowing three dimensional play.

U.S. Pat. No. 3,508,753 granted Apr. 28, 1970 to Mackey discloses a board game wherein the upper surface represents the surface of the water and the lower surface represents submerged areas permitting a war-type game including ships, depth charges, submarines and torpedos.

U.S. Pat. No. 4,232,864 granted to Yaworsky Nov. 11, 1980 which discloses a three dimensional game apparatus wherein a minimum of two identical playing surfaces are superimposed during play. The playing pieces and the playing surfaces are partially transparent to permit observation of the location of the playing pieces during play.

DISCLOSURE OF THE INVENTION

The present invention contemplates a game of strategy wherein the playing pieces are played, in turn, by opposing players without the ability to see the location of the pieces which have been played previously.

The game apparatus is cubical in configuration, of a solid material, and has a plurality of vertical bores.

Though the game is played in the vertical mode, i.e. one playing piece is stacked upon a previously played piece in the same bore, the scoring is in accord with pieces in a line in a given horizontal plane. Means is provided to remove the pieces from the apparatus one layer at a time.

The players of the game need to either block the scoring of an opponent or, in the alternative, play to score themselves, either strategy requires that memory be utilized as to whose piece was last played in which bore and how many had been played previously i.e. into which layer the next piece in a given column or bore will go.

With the above noted prior art in mind, it is an object of the present invention to provide a multidimensional game requiring strategy, skill and memory.

Another object of the present invention is to provide a game which is three dimensional in strategy and yet simple of construction. The game apparatus allows sequential non-destructive access to individual levels or layers of the playing pieces to accommodate scoring by layer.

Yet another object of the present invention is to provide a means for removing an individual layer from multiple stacks of game pieces without disturbing the vertical or horizontal ordering of the remaining game pieces.

Still a further object of the present invention is to provide a unique dispensing mechanism which in the normal position supports a plurality of stacks of individual elements. Movement of the dispensing mechanism permits the removal of a single layer of playing pieces i.e. one from each of the stacks including pieces, while retaining the integrity of position of the remaining game pieces.

BEST MODE FOR CARRYING OUT THE INVENTION

Figure 1:
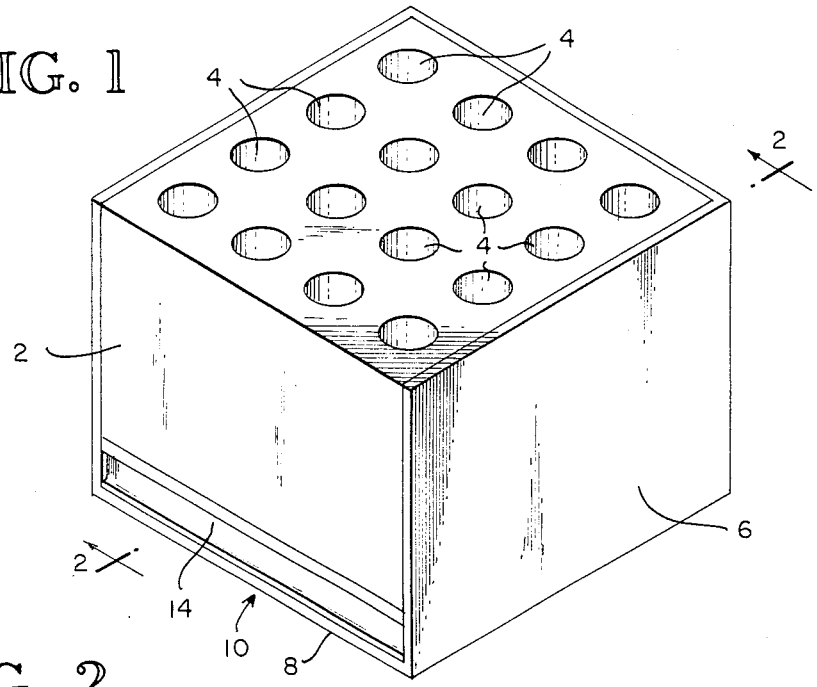
FIG. 1 is a perspective view of the present inventive game structure as it would appear during play.

As seen in FIG. 1, the inventive game consists of a substantially solid main body portion 2 having a plurality of vertical bores 4, deep enough to receive a plurality of playing pieces, which in the preferred embodiment are marbles. The exterior of the device, in the preferred embodiment is covered with an exterior opaque shell 6 of desired material. The shell 6 is used to improve the appearance of the main game piece, and to provide a base element upon which drawer or dispensing element 10 is supported and captured. It is to be understood that there are many other structural ways of supporting the dispensing element or drawer 10, however, the device as shown is believed to be efficient, inexpensive and attractive.

Figure 2:
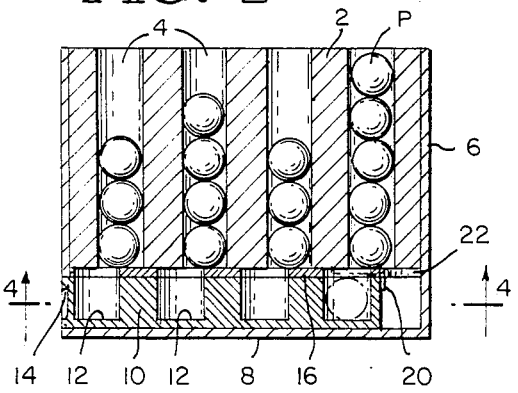
FIG. 2 is a vertical section along lines 2—2 of FIG. 1 depicting the playing piece retention means and the removal drawer in playing position.

Referring now to FIG. 2, which is a vertical elevational view along line 2—2, it can be seen that the bores 4 extend the full depth of the main body portion 2 whereas the exterior surfacing or shell 6 extends below the main body portion to terminate in a base member 8 which as noted above supports the drawer dispensing device 10. As seen in this view drawer 10 is located in the position it would occupy during play includes a plurality of cups 12 spaced such that they can be located to simultaneously underlie all of the bores 4.

A groove 14 is machined in the face member of the drawer 10 such that the drawer is flush with the front of the main body 2 during normal use. As explained hereafter, the drawer or tray 10 can be easily actuated to capture the bottom layer of pieces with this layer of pieces and be removed. Also seen in this view, and as will be explained in greater detail hereinafter, a slide or stopper member 16 is located between the bottom of the base member 2 and the top of drawer 10 to retain the playing pieces in the bores until the end of the game.

As seen in FIG. 2, drawer 10 and the slide member 16 are in the position occupied during play and are located such that their respective bores and cups are not coaxial with the bores 4 in the main body member. This allows players in turn to place their playing pieces within the bores allowing the playing pieces to stack within a bore without falling into the cups 12 of drawer 16.

Following the completion of play, i.e. when all pieces have been deposited, the drawer and slide are moved rearwardly against a resilient resistance 22 member until the bores 18 of slide 16 and cups 12 of drawer 10 are axially aligned with the bores 4. The cups 12 are of sufficient depth that one playing piece will fall into each cup 12 of the drawer 10 and thereby effectively capturing the bottom playing piece from each of the stacks of playing pieces. Upon removal of drawer 10, the slide 16 moves back to a position closing the bottom of each column 4.

Figure 3:
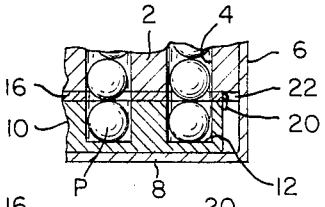
FIG. 3 is a partial section along lines 2—2 of FIG. 2 disclosing the dispensing drawer and the playing piece retention means moved rearwardly into the position for extracting a layer of playing pieces, i.e. both the drawer and the retention means have their openings aligned with the vertical bores.

FIG. 3 which is a partial section, depicts a playing piece in each of the cups 12 illustrated. The slide 16, the drawer 10 are shown in their rearwardmost position, i.e. in alignment with the bores 4, a playing piece has fallen into the cup 12 which is not deep enough to contain more than one piece. It is to be noted that element 20, which is secured to slide 16 and extends downwardly adjacent to and behind drawer 10, causes the slide and the drawer to move as a unit when the drawer is pushed rearwardly. The drawer 10 and slide 16 act as a unit when the compressed resilient member 22 expands and moves the slide forwardly. The latch element 20 abuts the back of drawer 10, moving the drawer 10 to a forward position where the front of the drawer is flush with the front of the cube. Drawer 10 is removable to accommodate scoring and it is to be noted that the resilient member 22 holds slide 16 in a forward position, blocking the bores 4, when the drawer is removed.

Figure 4:
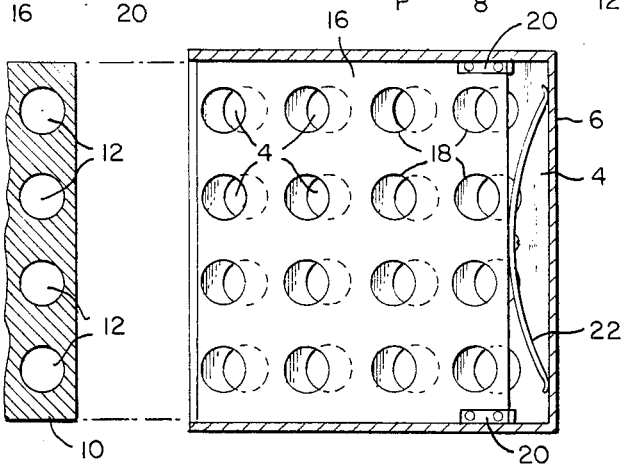
FIG. 4 is a horizontal plan view along lines 4—4 of FIG. 2 which illustrates the normal position of the game piece retention means; its return spring and, the removed drawer.

Referring now to FIG. 4, the offset in the bores 18 of slide 16 when in its normal position and bores 4 of the main body portion may more readily be seen. The bores 4 and 18 are aligned only when drawer 10 is pushed rearwardly. Further to be seen in this view is the resilient member 22 which keeps the slide member and the drawer in the forwardmost position during play. Also seen in this view is the fact that the drawer, as shown in phantom, can be removed for scoring. The leaf spring style resilient member 22 could obviously be replaced with other resilient mechanisms.

Thus, in play, each person in turn, using a different colored playing piece, places a playing piece in one of the bores 4 in an attempt to place enough playing pieces in a given line and a given plane to form a straight line across the layer. In order to be successful, the player must thus, without being able to see, remember where the pieces have been played and in which order since obviously playing a piece in one layer when you think you are playing it in another will not yield a score.

Thus as can be seen, a simple convenient playing cube apparatus enabling three dimensional play with two dimensional scoring.

I claim:

1. Game apparatus comprising:

a base unit substantially cubical in shape having a plurality of vertical bores extending therethrough, removable tray means including vertical bores exiting partially therethrough, said bores being coaxial with the bores in the base unit when the tray is in operational position, slide means, including a plurality of bores, between the bottom of the base unit and the tray means, said slide means movable between two positions, a first position obstructing the bores of the base unit and a second position having its bores in alignment therewith, a plurality of playing pieces adapted to be placed, one at a time in the vertical bores supported by the stop means whereby the pieces may be stacked several deep in each bore and selectively removed one layer at a time.

2. A game of strategy utilizing a three dimensional main playing piece and a plurality of individual playing pieces, said main playing piece comprising:

a solid main body portion having a plurality of vertical columns extending therethrough, drawer means underlying the main body portion, said drawer means including pockets of a size to hold only one playing piece and selectively alignable with the columns whereby the bottom layer of pieces may be removed, and means retaining the columns of playing pieces in position during play and when the drawer means is removed.

3. A game as in claim 2, wherein the means for retaining the column has a first position preventing pieces from exiting the bottom of the column and a second position allowing pieces to exit the bottom of the column.

4. A game as in claim 2 and further including resilient means urging the retaining means to the first position.

5. A game as in claim 4, wherein the drawer means and the retaining means move as a unit from the first position to the second position.

* * * * *